United States Patent [19]

Blau

[11] Patent Number: 4,486,117

[45] Date of Patent: Dec. 4, 1984

[54] FLEXIBLE TRAFFIC STANDARD

[75] Inventor: Herbert Blau, Philadelphia, Pa.

[73] Assignee: Blau & Lapides, Inc., Philadelphia, Pa.

[21] Appl. No.: 295,787

[22] Filed: Aug. 24, 1981

[51] Int. Cl.[3] ..... E01F 9/01

[52] U.S. Cl. ..... 404/10; 40/608; 248/622

[58] Field of Search ..... 404/10, 9; 256/13.1, 256/1; 40/607, 608, 612; 248/60, 622, 623; 52/165, 103

[56] References Cited

U.S. PATENT DOCUMENTS

| | | | |
|---|---|---|---|
| 2,101,176 | 12/1937 | Height | 256/13.1 |
| 3,502,007 | 3/1970 | Andersson | 404/10 |
| 3,799,686 | 3/1974 | Williams | 404/10 |
| 4,105,350 | 8/1978 | O'Donnell | 404/10 X |
| 4,122,795 | 10/1978 | Döring | 404/10 X |
| 4,290,712 | 9/1981 | Hayes | 404/10 |
| 4,298,292 | 11/1981 | Sweeney | 404/10 |
| 4,343,567 | 8/1982 | Sarver et al. | 404/10 |
| 4,354,772 | 10/1982 | Drexler | 404/10 |

FOREIGN PATENT DOCUMENTS

| | | | |
|---|---|---|---|
| 105985 | 12/1966 | Denmark | 404/10 |
| 940775 | 11/1963 | United Kingdom | 404/10 |

*Primary Examiner*—Stephen J. Novosad
*Assistant Examiner*—Beverly E. Hjorth
*Attorney, Agent, or Firm*—Walter B. Udell

[57] ABSTRACT

A flexible traffic standard which includes an anchor support assembly consisting of a hollow cylindrical tube and a driving point, and a resilient standard assembly comprising a tempered spring steel strap, the bottom end of which is disposed within a rigid tube, and a resilient tubular cover which encloses the strap and tube. The resilient standard assembly is disposed within the hollow cylindrical tube of the anchor support assembly and is secured by means of a pair of compression bolts. A rain boot prevents water from running down into the tube and a rain cap prevents the entry of water through the top of the flexible standard. The tempered spring steel strap which forms the resilient core of the device is reversely folded at its midpoint, to form a pair of upwardly extending resilient arms which are laterally outwardly offset by means of a twist in the spring steel at the midpoint reverse point. Straps are utilized as spacers to maintain the spring steel strap arms in properly spaced apart position with respect to one another so that the resilient tubular cover is snugly fitted about the arms.

5 Claims, 7 Drawing Figures

FLEXIBLE TRAFFIC STANDARD

This invention relates to flexible traffic standards, and more particularly relates to traffic standards which are generally designated as "forgiving" devices, and which may be used as traffic delineators or alternatively as mounts for signs.

A "forgiving" traffic standard or device is one which yields in some manner when it is impacted by a vehicle in motion, as distinguished from a rigid type device such as a steel pole, the purpose of these forgiving devices being the avoidance of injury to people who may be traveling in vehicles which impact the standards. The importance of this type of device has become apparent with the increase in accidents involving signposts and traffic lane standards which have been made of rigid materials that upon impact have snapped and penetrated spearlike into vehicles, in many cases causing death and very severe injuries.

In the past there have been various attempts to develop forgiving traffic standards and other devices, but these have not to the present time been successful. In some cases the standards have been made of low impact resistant plastic materials which have snapped off but are of such light weight that they cannot cause the type of damage which has in the past occurred with strong steel devices. Other forms have utilized materials which will bend over, but which after the impact are not reusable, having essentially also been destroyed by the impact. Yet another type of device has taken the form of spring supported cushioning pads or bumpers which are shock absorbent to a certain degree, but which again are substantially destroyed by the impacting vehicle.

The flexible traffic standard according to the invention is not subject to the limitations of these previously known devices, but is a resilient device which bends completely over upon impact, allowing the vehicle to ride over and past it, and thereafter resiliently returns to its normal use position. It thus achieves the advantages of safety to people combined with an effective low cost because it remains usable and need not be immediately replaced with a new unit. It has the additional advantages of being relatively simple in construction, easily installed, and relatively inexpensive to manufacture. Preliminary testing has shown that the device according to the invention performs its function as intended.

Accordingly, it is a primary purpose of the invention to provide a flexible traffic standard of the "forgiving" type which deflects upon impact into an out-of-the-way position to allow an impacting vehicle to pass across it, and when clear of the vehicle resiliently restores to its normal use position.

Another object of the invention is to provide a forgiving flexible traffic standard as aforesaid which is relatively simple in construction, inexpensive to manufacture and install, and economical in use because of its reusability.

The foregoing and other objects of the invention will become clear from a reading of the following specification in conjunction with an examination of the appended drawings, wherein.

Figure 1:
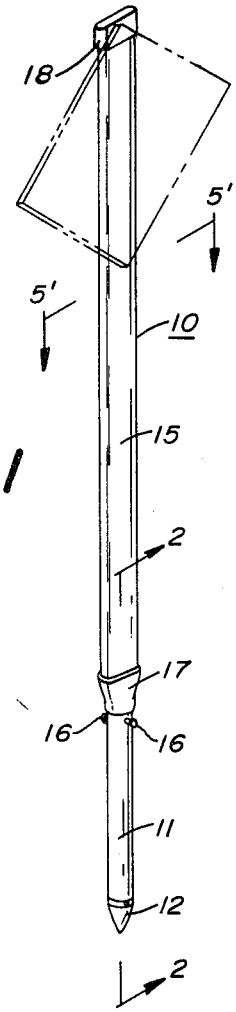
FIG. 1 is a perspective view of the flexible traffic standard according to the invention also showing in phantom outline the position for attachment of a sign when the standard is used as a sign post.
Figure 2:
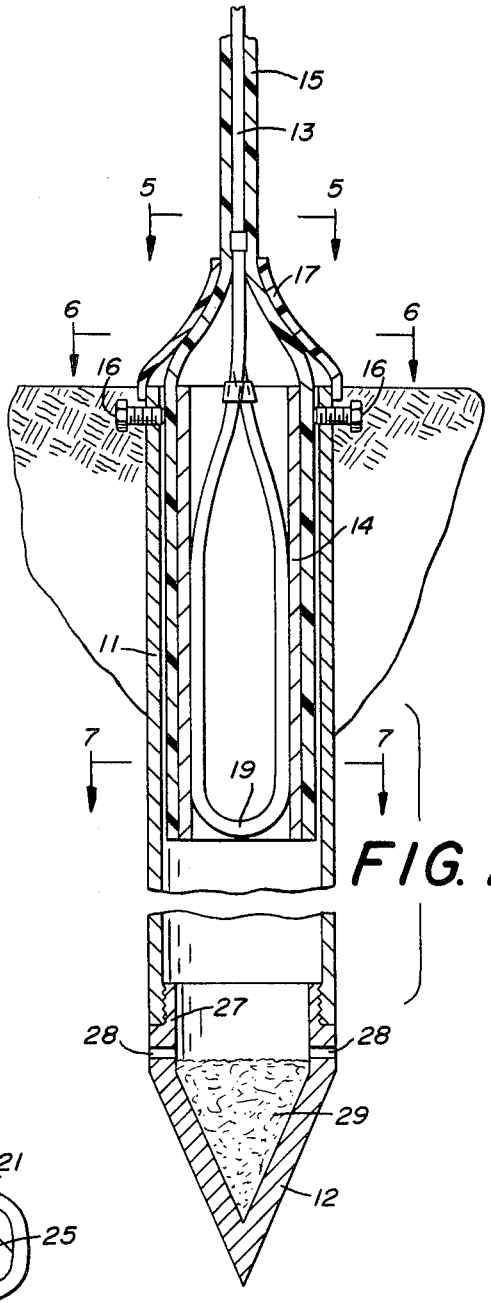
FIG. 2 is a vertical cross sectional view on an enlarged scale of the lower portion of the flexible traffic standard structure as would be seen when viewed along the line 2—2 of FIG. 1.
Figure 5:
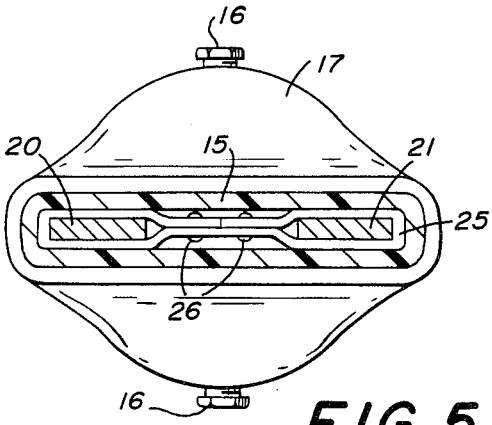
Figure 6:
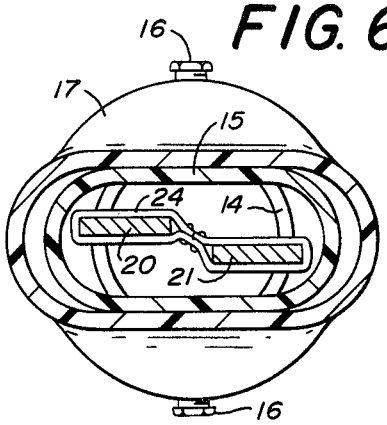
Figure 7:
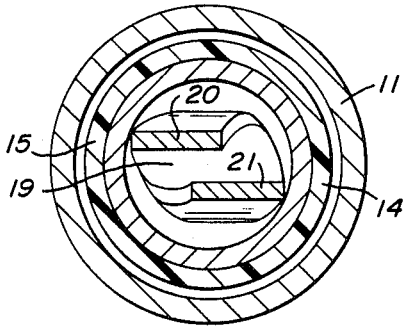

FIGS. 5 and 5′ are horizontal cross-sectional views through the standard according to the invention as would be seen when viewed along the lines 5—5 on FIG. 2 and 5′—5′ on FIG. 1;

FIG. 6 is a cross-sectional view through the standard according to the invention as would be seen when viewed along the line 6—6 on FIG. 2; and FIG. 7 is a cross-sectional view through the standard according to the invention as would be seen when viewed along the line 7—7 on FIG. 2.

In the several figures, like elements are denoted by like reference characters.

Referring now to the drawings, there is seen a flexible traffic standard designated generally as 10 which includes an anchor support assembly consisting of a hollow cylindrical tube 11 and a driving point 12, and a resilient standard assembly comprising a spring steel strap 13, the bottom end of which is disposed within a rigid tube 14, and a resilient tubular cover 15 which encloses the strap 13 and tube 14. The resilient standard assembly is disposed within the hollow cylindrical tube 11 and secured by means of a pair of compression bolts 16. A rain boot 17 prevents water from running down into the tube 11, and a rain cap 18 prevents the entry of water through the top of the flexible standard.

Figure 3:
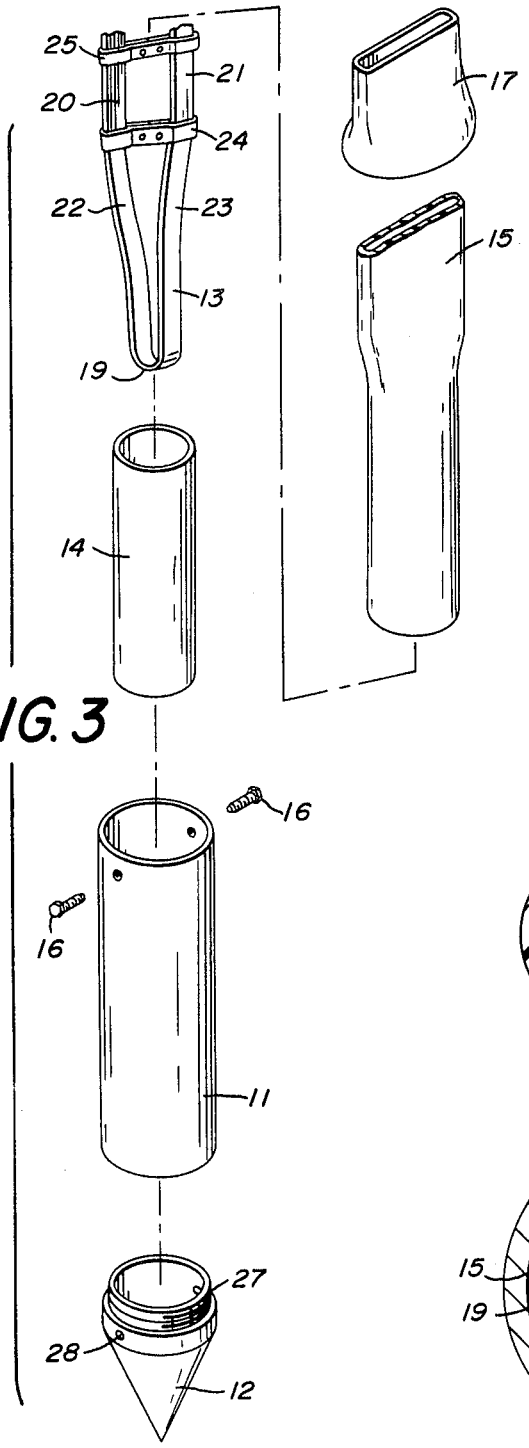
FIG. 3 is an exploded isometric view of the lower portion of the flexible traffic standard shown in FIGS. 1 and 2.
Figure 4:
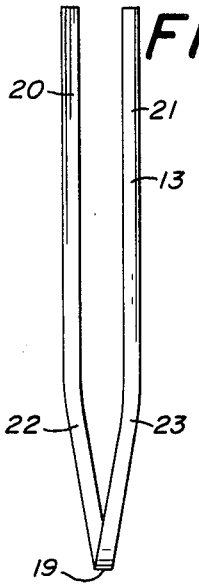
FIG. 4 is an elevational view of the lower end of the spring steel core of the device shown at right angles to the view of the same seen in FIG. 2.

The tempered spring steel strap 13 which forms the resilient core of the device is reversely folded at its midpoint, as shown at 19 in FIGS. 2, 3 and 4, to form a pair of upwardly extending resilient arms 20 and 21 which are laterally outwardly offset as at 22 and 23 by means of a twist in the spring steel at the midpoint reverse point 19, as most clearly seen in the showing of FIG. 7. As the arms 20 and 21 rise from the bottom midpoint loop 19 and diverge in the offsetting direction they also move closer to an in-plane condition as shown progressively in FIGS. 6 and 5. In order to hold the formed tempered spring steel strap 13 in its desired shape condition, an offset strap 24 is secured about the arms 20 and 21 as shown in FIG. 6, and a flat strap 25 is secured about the arms 20 and 21 at the positions shown in FIGS. 5 and 5′, the straps 24 and 25 being secured in any convenient manner, as for example by rivets 26.

The straps 25 are utilized as spacers to maintain the spring steel strap arms 20 and 21 in properly spaced apart position with respect to one another so that the resilient tubular cover 15 is snugly fitted abuut the arms 20 and 21. Without the straps 25, the arms 20 and 21 would be biased toward one another by the resilient tubular cover 15 and the standard would not maintain its desired flat shape. It has been found that the arms 20 and 21 should be left free at their upper ends rather than being secured to one another or to any fixed end plate since such securement appears to effect a reduction in the flexibility of the standard.

The hollow cylindrical tube 11 is provided with threaded through holes at its upper end through which are threaded the compression bolts 16, and is further provided at its bottom end with a series of internal threads into which is threadedly secured the threaded upper end 27 of the driving point 12. The driving point 12 is also apertured as at 28 at its upper end below the threaded region to permit the drainage of any water which might find its way into the tube 11. The bottom interior of the driving point 12 is filled with a bituminous material 29 up to the level of the apertures 28 so that water cannot collect in the bottom of the driving point.

The standard is assembled by first taking the formed tempered spring steel strap 13, securing to it the offset and flat straps 24 and 25, placing the bottom loop within the rigid tube 14, installing that assembly within the resilient tubular cover 15, slipping the assembly downward into the hollow cylindrical tube 11 to a point where the upper end of the rigid tube 14 is substantially level with the upper end of the hollow cylindrical tube 11, turning in the compression bolts 16 until they lock against the resilient tubular cover 15 and cannot be driven further without stripping threads or bending the tubes 11 or 14, slipping the rain boot 17 down over the flat top of the standard and seating it over the upper edge of the hollow cylindrical tube 11, and snapping on the rain cap 18 if this had not previously been done.

Prior to this assembly, the cylindcival tube 11 with the driving point 12 secured thereto as shown in FIG. 2, is of necessity driven downward into the ground at the point for erection of the standard. If this is at a roadside, normally the dirt is exposed for installation. If the standard is to be erected at some point on the surface of a paved road, it is necessary to cut down through the paving which may be macadam, asphalt or concrete, in order to place the anchor tube in position so that the standard may be inserted and secured thereto.

The tempered spring steel strap could be made of material ½" wide and 3/16" thick, these particular dimensions of this material having been found in practice to function well as a forgiving traffic standard. The resilient tubular cover 15 would typically be made of rubber or flexible plastic, as would be the rain boot 17 and rain cap 18. Typically, the flexible traffic standard would be approximately four feet in length above ground level when used as a traffic delineator, and would be five feet above ground level for a sign standard. The length of the rigid tube 14 may suitably be approximately nine inches, while the length of the hollow cylindrical tube 11 and driving point 12, as an assembly, could typically be on the order of eighteen inches. The width of the upstanding flexible traffic standard in the regions of the cross section of FIG. 5 would be typically three or four inches.

Having now described the invention in connection with a particularly illustrated embodiment thereof, variations and modifications of the invention may now naturally occur from time to time to those persons normally skilled in the art without departing from the essential scope or sprit of the invention, and accordingly it is intended to claim the same broadly as well as specifically as indicated by the appended claims.

What is claimed to be new and useful is:

1. A flexible standard comprising in combination a linearly extending flexible resilient composite element having a resilient core member and a flexible cover sheath, said resilient core being metallic and comprising a pair of spaced apart parallel extending strips of tempered spring steel with spacer means extending between said pair of strips effective to hold said pair of strips in fixed spaced apart relationship to one another, and a mounting base to which the lower end of said composite element is releasably secured, said flexible resilient composite element being much longer in length than in width.

2. A flexible standard as described in claim 1 wherein said pair of parallel strips of tempered spring steel are part of one strap reversely folded to form a bottom loop from which upwardly extend the said parallel strips as separate arms.

3. A flexible standard as described in claim 2 wherein said resilient core further includes a rigid tube within which the said bottom loop and a portion of said strap thereabove is close fittingly disposed, whereby said rigid tube positionally stabilizes said strap, said flexible cover sheath extending downward to cover at least a portion of the upper end of said rigid tube.

4. A flexible standard as described in claim 1 or 3 wherein said mounting base comprises a ho11ow tubular member open at the top and closed at the bottom, said tubular member being adapted to be buried with its closed end down and its open end up and substantially flush with the ground surface, and including means proximate to its upper end for detachably locking the lower end of said flexible resilient composite element thereto, the lower end of said flexible resilient composite element being close fittingly projectable downward into said hollow tubular member.

5. A flexible standard as described in claims 1, 2 or 3 wherein said flexible resilient composite element is substantially four to five feet in vertical length and approximately three to four inches in width.

* * * * *